US008113586B2

(12) United States Patent
Chen

(10) Patent No.: US 8,113,586 B2
(45) Date of Patent: Feb. 14, 2012

(54) APPARATUS FOR ADJUSTING THE SEAT BACK ANGLE

(76) Inventor: Yung-Hua Chen, Sinjhuang (TW)

( * ) Notice: Subject to any disclaimer, the term of this patent is extended or adjusted under 35 U.S.C. 154(b) by 438 days.

(21) Appl. No.: 12/320,298

(22) Filed: Jan. 23, 2009

(65) Prior Publication Data

US 2010/0187883 A1 Jul. 29, 2010

(51) Int. Cl.
*A47C 1/024* (2006.01)

(52) U.S. Cl. ..... 297/303.5; 297/301.1; 297/301.4

(58) Field of Classification Search ..... 297/300.5, 297/301.1, 301.4, 302.4, 303.5
See application file for complete search history.

(56) References Cited

U.S. PATENT DOCUMENTS

| | | | | | |
|---|---|---|---|---|---|
| 964,012 | A * | 7/1910 | Folts | 297/302.4 |
| 2,018,825 | A * | 10/1935 | Wood | 297/301.4 |
| 2,208,561 | A * | 7/1940 | Jungbauer | 297/303.5 |
| 4,232,900 | A * | 11/1980 | Parker | 297/300.5 |
| 4,533,177 | A * | 8/1985 | Latone | 297/303.5 |
| 4,709,962 | A * | 12/1987 | Steinmann | 297/300.3 |
| 4,913,492 | A * | 4/1990 | Shovar | 297/300.7 |
| 5,344,215 | A * | 9/1994 | Dahlbacka | 297/375 |
| 5,909,926 | A * | 6/1999 | Gonzalez | 297/354.12 |
| 6,149,236 | A * | 11/2000 | Brauning | 297/301.2 |
| 6,669,294 | B2 * | 12/2003 | Kinoshita et al. | 297/354.1 |
| 7,159,943 | B2 * | 1/2007 | Costaglia | 297/323 |
| 7,490,902 | B2 * | 2/2009 | Aubert | 297/300.5 |
| 2004/0130196 | A1 * | 7/2004 | Costaglia | 297/300.5 |
| 2004/0130197 | A1 * | 7/2004 | Costaglia | 297/300.5 |
| 2005/0280300 | A1 * | 12/2005 | Tin | 297/300.3 |
| 2006/0181128 | A1 * | 8/2006 | Takeuchi et al. | 297/301.4 |
| 2008/0252124 | A1 * | 10/2008 | Chen | 297/301.4 |
| 2010/0001567 | A1 * | 1/2010 | Powicki et al. | 297/301.1 |
| 2010/0096894 | A1 * | 4/2010 | Fukai | 297/300.5 |

FOREIGN PATENT DOCUMENTS

EP 105955 A1 * 4/1984

* cited by examiner

*Primary Examiner* — David Dunn
*Assistant Examiner* — David E Allred
(74) *Attorney, Agent, or Firm* — Rosenberg, Klein & Lee

(57) ABSTRACT

An apparatus for adjusting the seat back angle, and more particularly an adjuster inclinedly disposed at a lower position of the bottom of the seat back and the rear side of the seat portion, comprising a rotating sleeve, an L-shaped connection body, a large spring, a shift shaft, and a locking device. When the locking device is locked, the seat back is positioned at a desirable inclination angle. When the locking device is unlocked, the shift shaft is axially movable such that the seat back is resiliently supported. Moreover, the compression state of the large spring is adjustable by a to-and-fro rotation of the rotating sleeve. In this way, the operators may adjust the resilience of the seat back 200 according to their own needs for obtaining a greatest sitting comfort.

4 Claims, 12 Drawing Sheets

APPARATUS FOR ADJUSTING THE SEAT BACK ANGLE

BACKGROUND OF THE INVENTION

1. Field of the Invention

The invention relates to an apparatus for adjusting the seat back angle, and more particularly to an apparatus that ensures a fixed inclination of the seat back and permits a resilient swing of the seat back. Moreover, the tightness thereof is adjustable.

2. Description of the Related Art

The conventional office chair is ergonomically designed to achieve an optimal sitting comfort. It would be better if the angle of the seat back is adjustable. As shown in FIG. 1, a conventional office chair 10 includes primarily a seat portion 11 that is supported by a support base 12. A seat back 13 is positioned at the rear side thereof. When the operator is tired, he can lean against the seat back for taking a rest. However, an L-shaped bar 14 is interposed between the seat back 13 and the seat portion 11. Therefore, the position of the seat back 13 stays unchanged, and an inclination for an optimal sitting comfort is not obtained when the operator leans against the seat back for taking a rest.

FIG. 2 illustrates another conventional office chair 20 whose structure is the same to the structure in FIG. 1 except the shape. As shown in FIGS. 3A and 3B, the office chair 30 has the function of adjusting the angle of the seat back. A retainer 34 is interposed between a seat portion 31 and the support portion 32. In other words, the retainer 34 is pivotally attached by pivoted bolts 321 to the top 323 of the support portion 32. Moreover, a spring 322 is positioned at the front end thereof for providing a resilient force when the retainer 34 is inclined backwards. The above-mentioned structure permits a backward inclination of the seat back 33. However, the seat back 33 and the seat portion 31 create an L-shaped backward inclination. It is not suitable for the operator who wants to lean his back backwards and does not want to raise the seat portion. The retainer 34 has to bear the whole weight when the seat portion is swiveled. Therefore, the entire structure becomes so heavy that the flexibility of the office chair is lost. Besides, the seat portion 31 that is inclined backward will easily lose the center of gravity. Therefore, the operator has to take care of inclination when sitting on the chair. Otherwise, the entire chair can tip over backwards.

As shown in FIG. 4, an office chair 40 disclosed in U.S. Pat. No. 6,149,236 includes an inclination-adjustment pneumatic spring 43 between a rear support 41 and a seat support 42 for providing a cushioning resilience for the rear support 41. The above-mentioned pneumatic adjustment structure will be practical when it is upright and used for adjusting the height of the seat support 42 on the shaft portion 44. However, the resilience and the flexibility to change with the to-and-fro swing of the operator's body are not optimal when it is applied to the rear support 41. Therefore, it requires further improvements.

SUMMARY OF THE INVENTION

An object of the invention is to provide an apparatus for adjusting the seat back angle that combines the locking and unlocking function into one body. When in locked position, the seat back is positioned at a preset inclination angle as required. When in unlocked position, the seat back is resiliently supported. Moreover, the operators may adjust the swing resilience of the seat back 200 according to their own needs for obtaining a greatest sitting comfort.

Another object of the invention is to provide an apparatus for adjusting the seat back angle that is mechanically made without employing pneumatic or electronic elements, thereby permitting a convenient operation and ensuring a long service life.

In order to achieve the above-mentioned objects, an apparatus for adjusting the seat back angle in accordance with the invention includes:

a) a rotating sleeve having an opening at the front end thereof such that a cavity is created, a threaded hole being positioned in axial direction at the center of the bottom of the cavity;

b) an L-shaped connection body having a threaded rod at the lateral side thereof, the threaded rod being screwed into the threaded hole of the rotating sleeve, the threaded rod of the connection body having a through hole extended in axial direction, the L-shaped connection body having a first pivoted portion at the longitudinal side thereof, a longitudinal hole extending to the through hole being formed in the connection portion between the longitudinal side of the connection body and the threaded rod;

c) a large spring having a tail portion fitting into the cavity of the rotating sleeve;

d) a shift shaft having a second pivoted portion at the front end thereof, the second pivoted portion having a pivotal hole, a first stem having a smaller external diameter being positioned at the internal side of the second pivoted portion, a second stem having a still smaller diameter being disposed at the internal side of the first stem and fitting into the through hole of the threaded rod, an end stop having an external diameter greater than the through hole being formed at a connection area between the first stem and the second stem, the tail of the shift shaft passing through the large spring and the through hole first whereupon a positioning element at the end of the shift shaft is employed to fix the shift shaft within the connection body in such a manner that the shift shaft is axially movable and the large spring is confined between the second pivoted portion and the cavity, the second stem being provided with a plurality of pin holes corresponding to the longitudinal hole of the connection body; and e) a locking device mounted on the longitudinal hole of the L-shaped connection body, an insertion pin at the front end of the locking device fitting in the longitudinal hole and being extended into a prearranged pin hole of the second stem such that the shift shaft is locked in an unmovable state, the locking device further having a control lever;

wherein, when the insertion pin is removed with the control lever, the shift shaft is unlocked in an axially movable state, and wherein the compression state of the large spring is adjustable by a to-and-fro rotation of the rotating sleeve on the threaded rod, thereby achieving a practical control of the telescopic tightness of the shift shaft.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
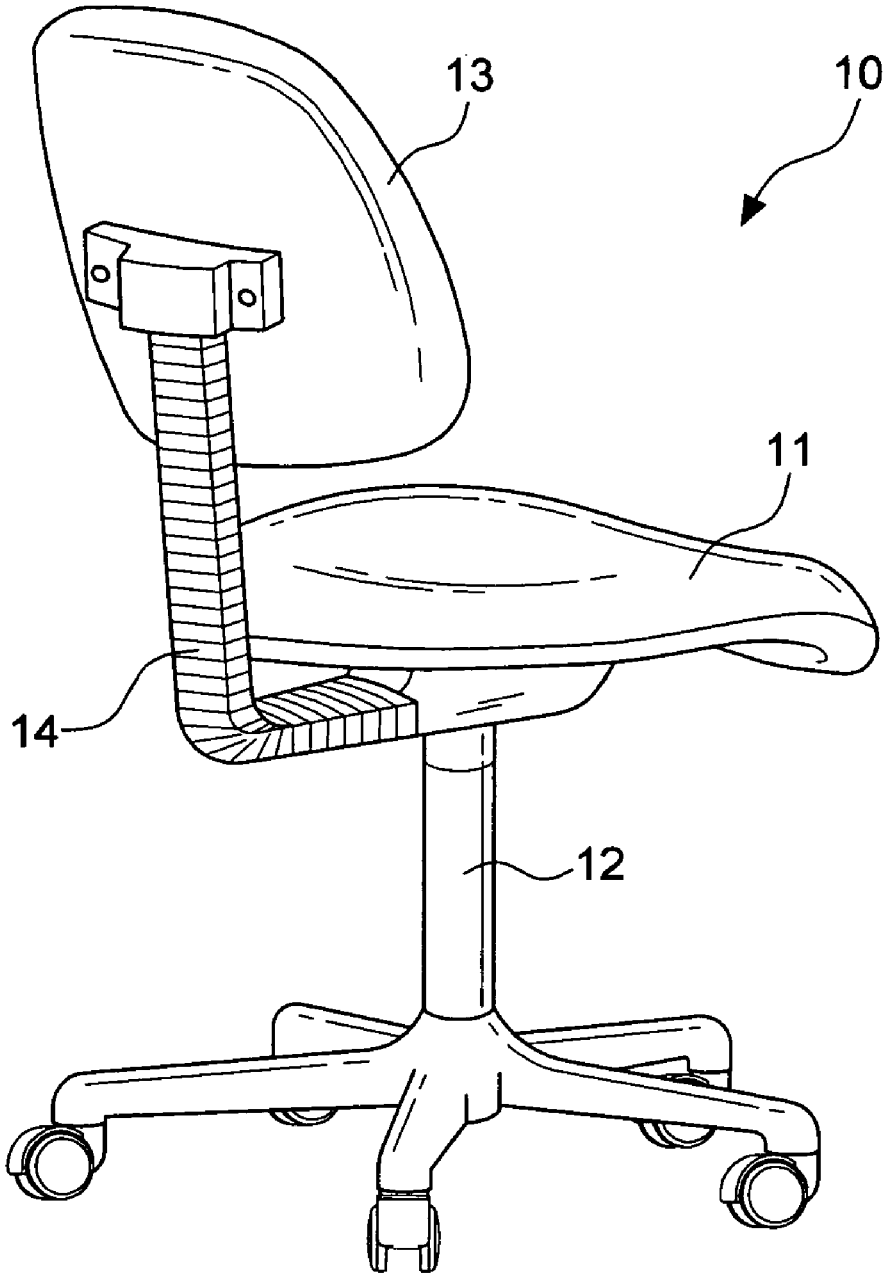
FIG.1 PRIOR ART
FIG. 1 is a perspective view of a conventional office chair.
Figure 2:
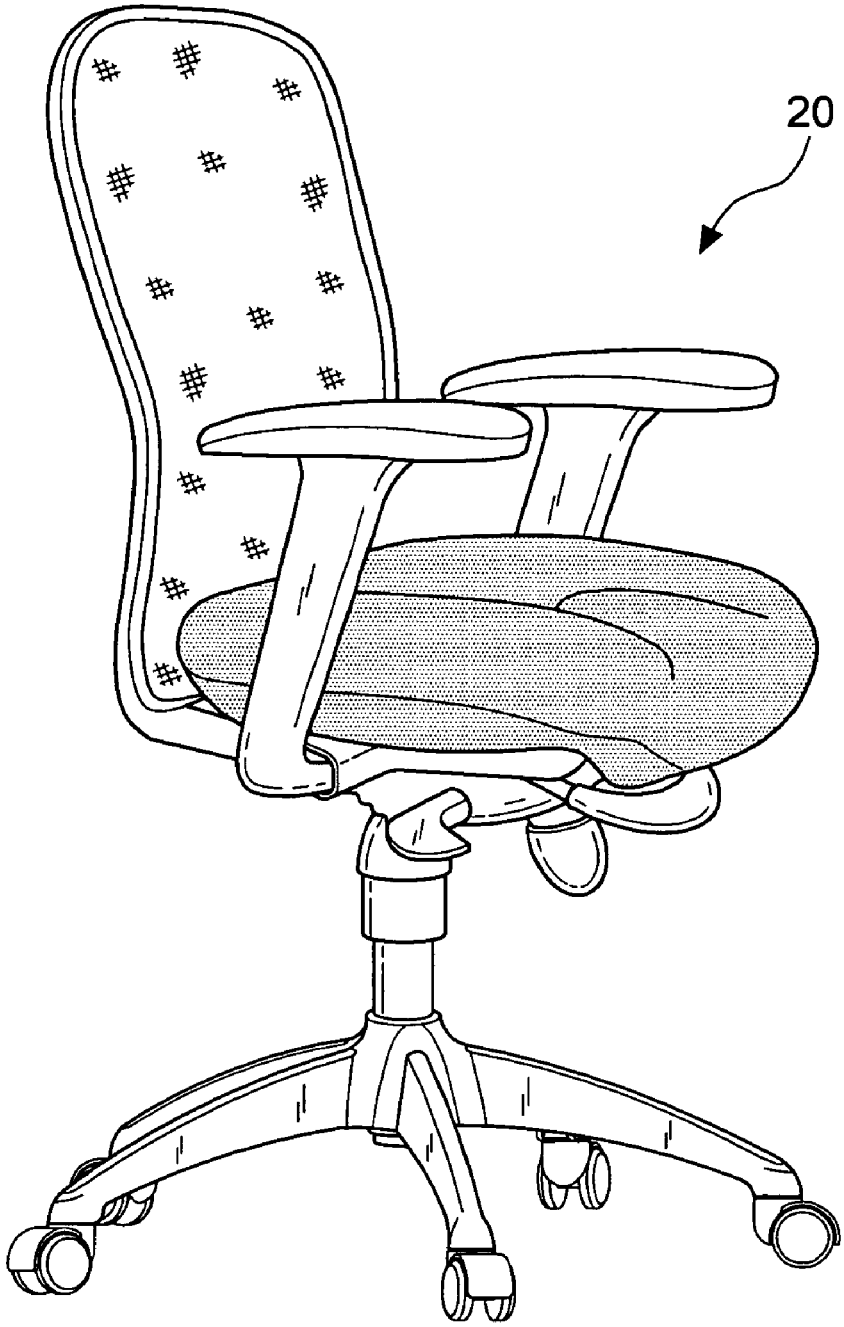
FIG.2 PRIOR ART
FIG. 2 is a perspective view of another conventional office chair.
Figure 3A:
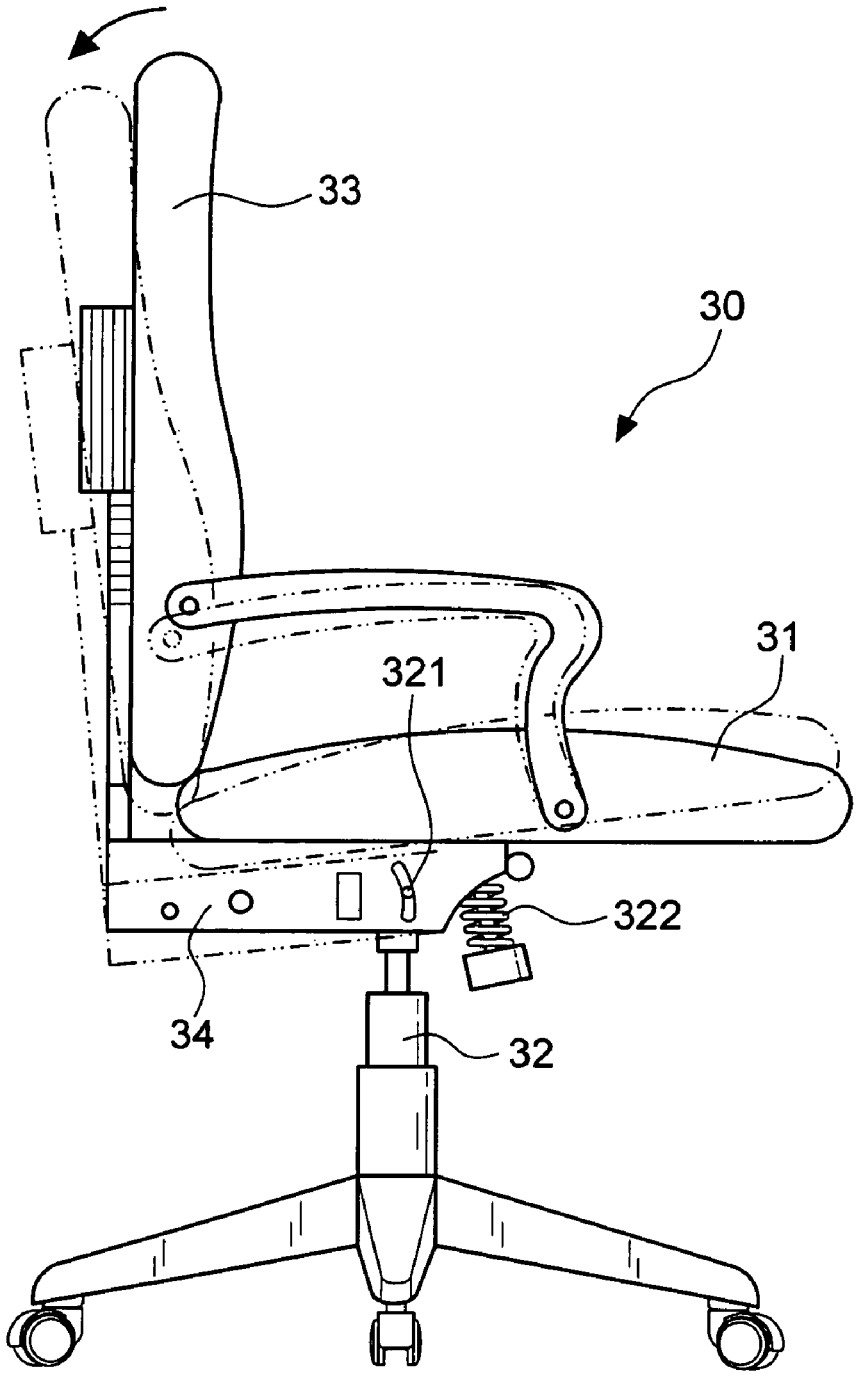
FIG.3A PRIOR ART
FIG. 3A is a side view of a conventional angle-adjustable office chair.
Figure 3B:
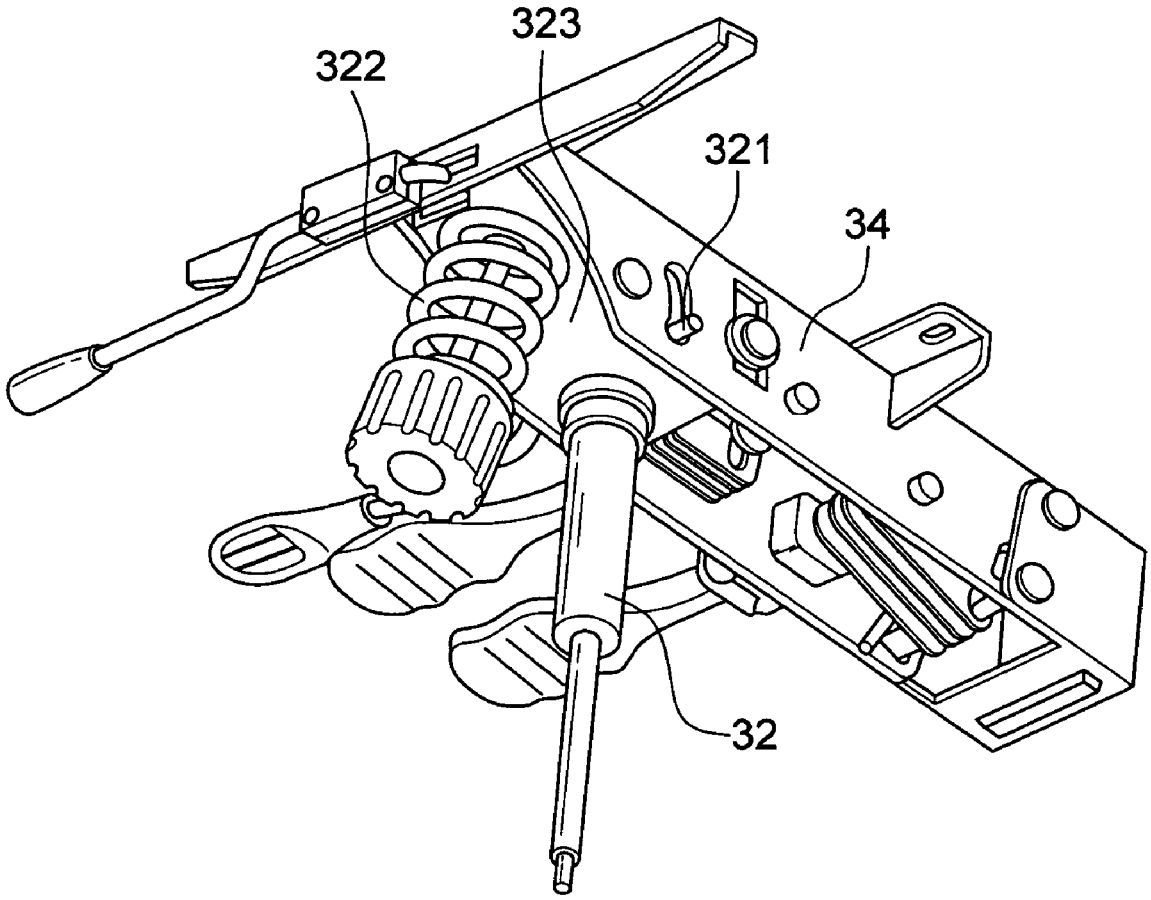
FIG.3B PRIOR ART
FIG. 3B is a perspective view of partial components in FIG. 3A.
Figure 4:
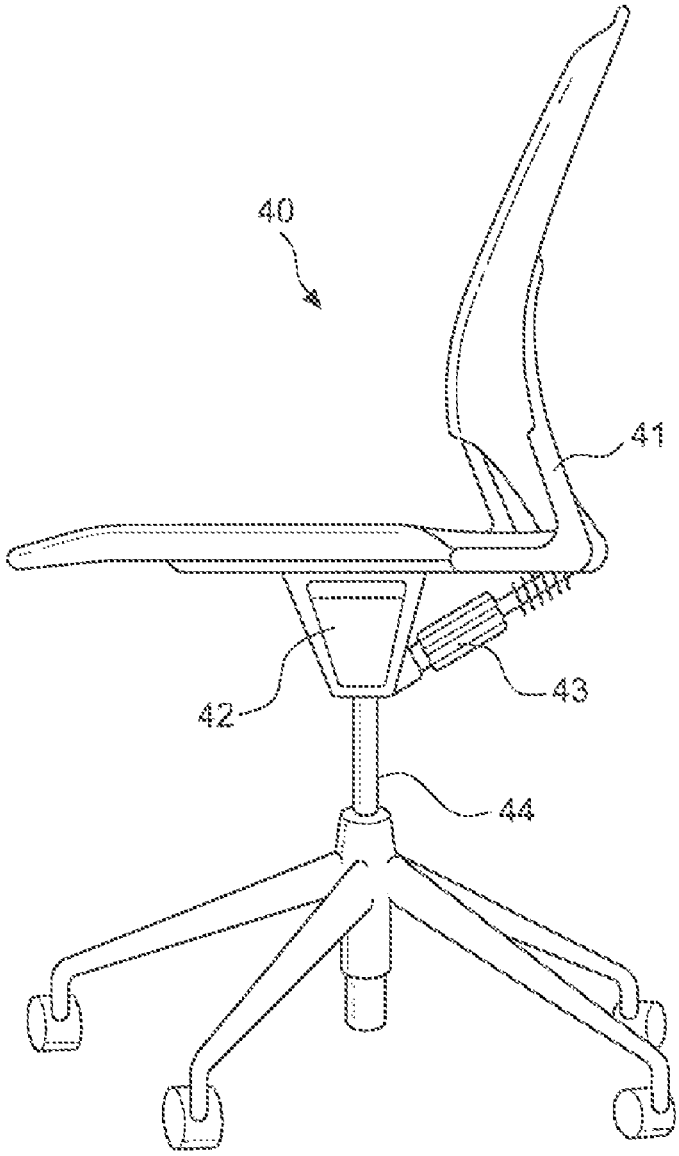
FIG.4 PRIOR ART
FIG. 4 is a schematic drawing of the structure according to U.S. Pat. No. 6,149,236.
Figure 5:
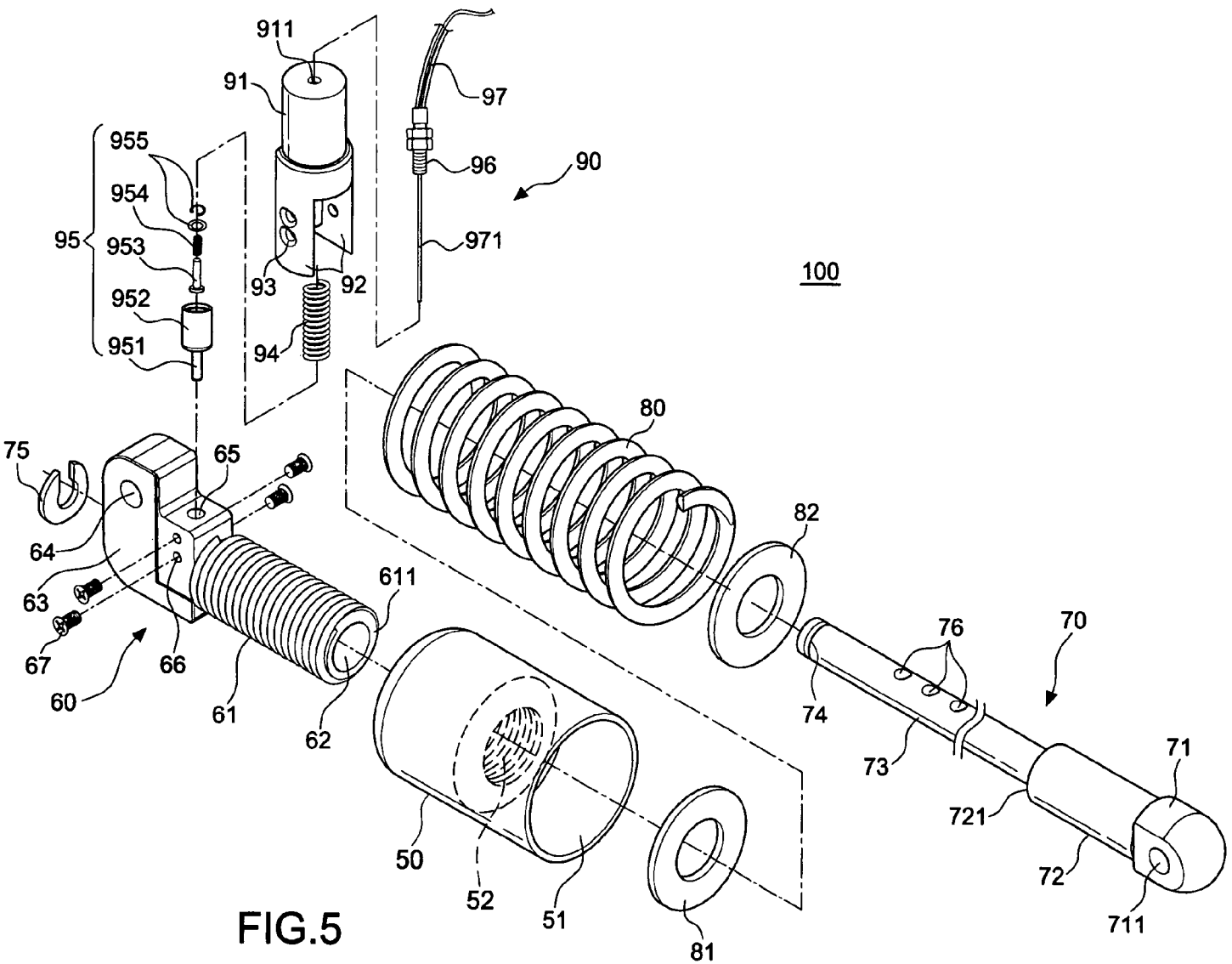
FIG. 5 is an exploded perspective view of an apparatus for adjusting the seat back angle in accordance with the invention.
Figure 6:
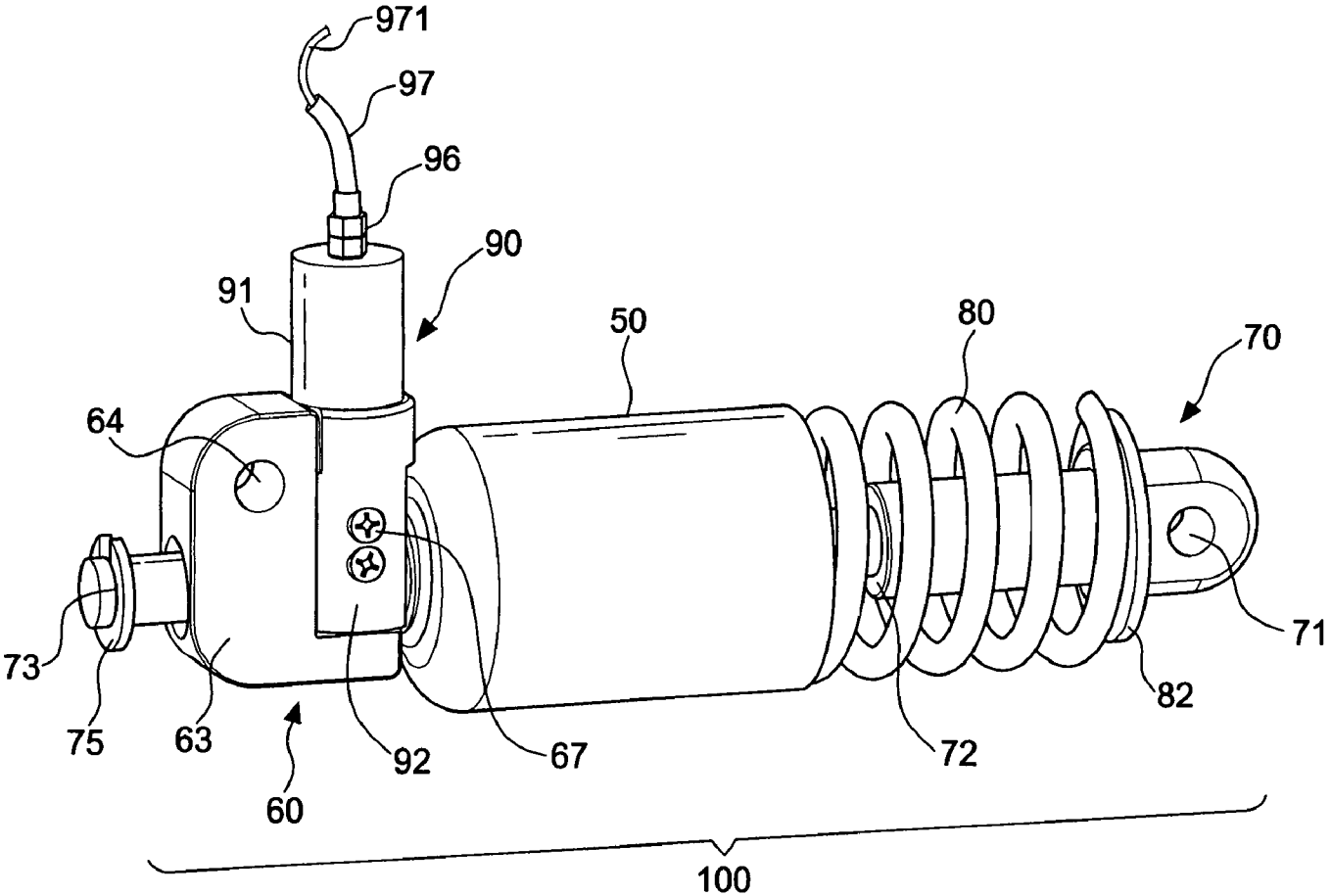
FIG. 6 is an assembly perspective view of an apparatus for adjusting the seat back angle in accordance with the invention.

First of all, referring to FIGS. 5 through 8, an apparatus in accordance with the invention includes a rotating sleeve 50, an L-shaped connection body 60, a shift shaft 70, a large spring 80, and a locking device 90.

The rotating sleeve 50 includes an opening at the front end thereof such that a cavity 51 is created. A threaded hole 52 is positioned in axial position at the center of the bottom of the cavity 51.

The L-shaped connection body 60 includes a threaded rod 61 at the lateral side thereof. The threaded rod 61 is screwed into the threaded hole 52 of the rotating sleeve 50. The threaded rod 61 of the connection body 60 has a through hole 62 extended in axial direction. Moreover, the L-shaped connection body 60 includes a first pivoted portion 63 at the longitudinal side thereof. The first pivoted portion 63 has a pivotal hole 64. A longitudinal hole 65 extending to the through hole 62 is formed in the connection portion between the longitudinal side of the L-shaped connection body 60 and the threaded rod 61.

The large spring 80 has a tail portion fitting into the cavity 51 of the rotating sleeve 50.

The shift shaft 70 includes a second pivoted portion 71 at the front end thereof. The second pivoted portion 71 has a pivotal hole 711. A first stem 72 having a smaller external diameter is positioned at the internal side of the second pivoted portion 71. A second stem 73 having a still smaller diameter is disposed at the internal side of the first stem 72 and fits into the through hole 62 of the threaded rod 61. An end stop 721 having an external diameter greater than the through hole 62 is formed at a connection area between the first stem 72 and the second stem 73. The tail of the shift shaft 70 passes through the large spring 80 and the through hole 62 first. Thereafter, a positioning element 75 at the end of the shift shaft 70 is employed to fix the shift shaft 70 within the L-shaped connection body 60 in such a manner that the shift shaft 70 is axially movable and the large spring 80 is confined between the second pivoted portion 71 and the cavity 51. Moreover, the second stem 73 is provided with a plurality of pin holes 76 corresponding to the longitudinal hole 65 of the L-shaped connection body 60.

The locking device 90 is mounted on the longitudinal hole 65 of the L-shaped connection body 60. An insertion pin 951 at the front end of the locking device 90 fits in the longitudinal hole 65 and is extended into a prearranged pin hole 76 of the second stem 73 such that the shift shaft 70 is locked in an unmovable state. The locking device 90 includes a control lever 98. When the insertion pin 951 is removed with the control lever 98, the shift shaft 70 is unlocked in an axially movable state. Moreover, the compression state of the large spring 80 is adjustable by a to-and-fro rotation of the rotating sleeve 50 on the threaded rod 61. In this way, a practical control of the telescopic degree of the shift shaft 70 is achieved.

In addition, a first pad 81 is interposed between the large spring 80 and the bottom of the cavity 51 of the rotating sleeve 50. A second pad 82 is interposed between the large spring 80 and the internal side of the second pivoted portion 71 of the shift shaft 70.

According to the embodiment, the positioning element 75 at the tail of the shift shaft 70 is a radially installed retaining clip engaged in a groove 74 at the tail of the shift shaft 70.

According to an applicable embodiment, the locking device 90 includes a housing 91, a middle spring 94, a telescopic locking element 95, and a connection element 96.

The housing 91 is hollow and has a connection hole 911 at the end portion thereof. Two positioning pieces 92 are extended from the bottom of the right and left sides of the housing 91. Moreover, the positioning pieces 92 are provided with through holes 93 in the lateral direction. In alignment to the longitudinal hole 65, the locking device 90 is mounted by the positioning pieces 92 on the L-shaped connection body 60 and fixed by screws 67 screwed through the through holes 93 into threaded holes 66 of the L-shaped connection body 60.

The middle spring 94 is positioned within the housing 91.

The telescopic locking element 95 includes an insertion pin 951 at the bottom thereof, a hollow plug 952 secured to the insertion pin 951, a stem 953 disposed within the hollow plug 952, a small spring 954 mounted on the stem 953, and two locking elements 955 fixing the small spring within the hollow plug 952 in place.

The connection element 96 is secured in the connection hole 911 of the housing 91. The connection element 96 is connected with a cable line 97, in which a pullable guide wire 971 is positioned. The front end of the guide wire 971 passes through the housing 91 and is secured to the stem 953. The free end of the guide wire 971 is attached to a control lever 98 disposed on a chair. The guide wire 971 is controlled by the control lever 98 to impart an axial motion to the telescopic locking element 95.

Based on the above-mentioned structure, the operation and the effect of the invention are described more hereinafter.

Figure 7:
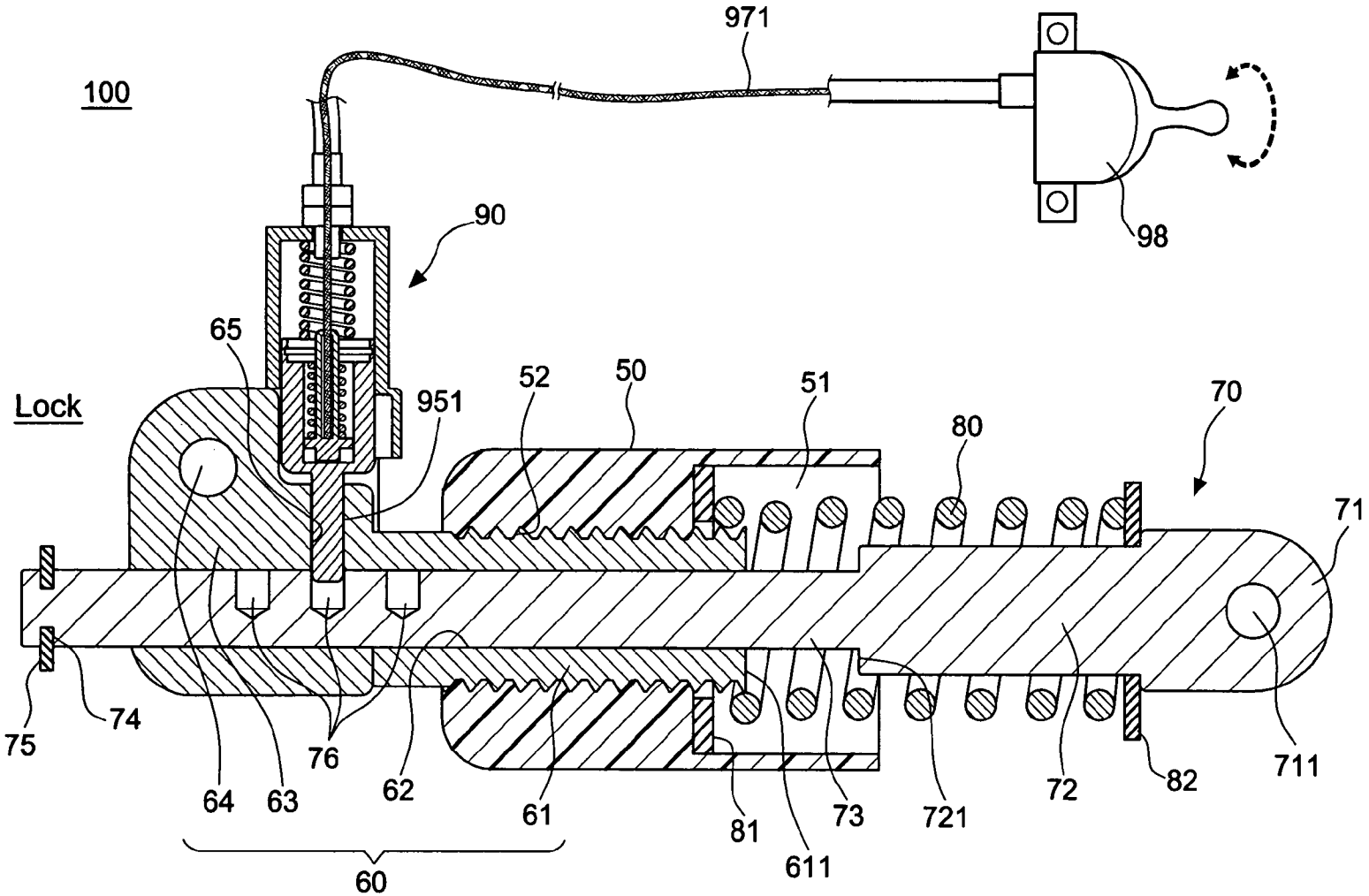
FIG. 7 is a cutaway view of an apparatus for adjusting the seat back angle in accordance with the invention in a locked position.
Figure 8:
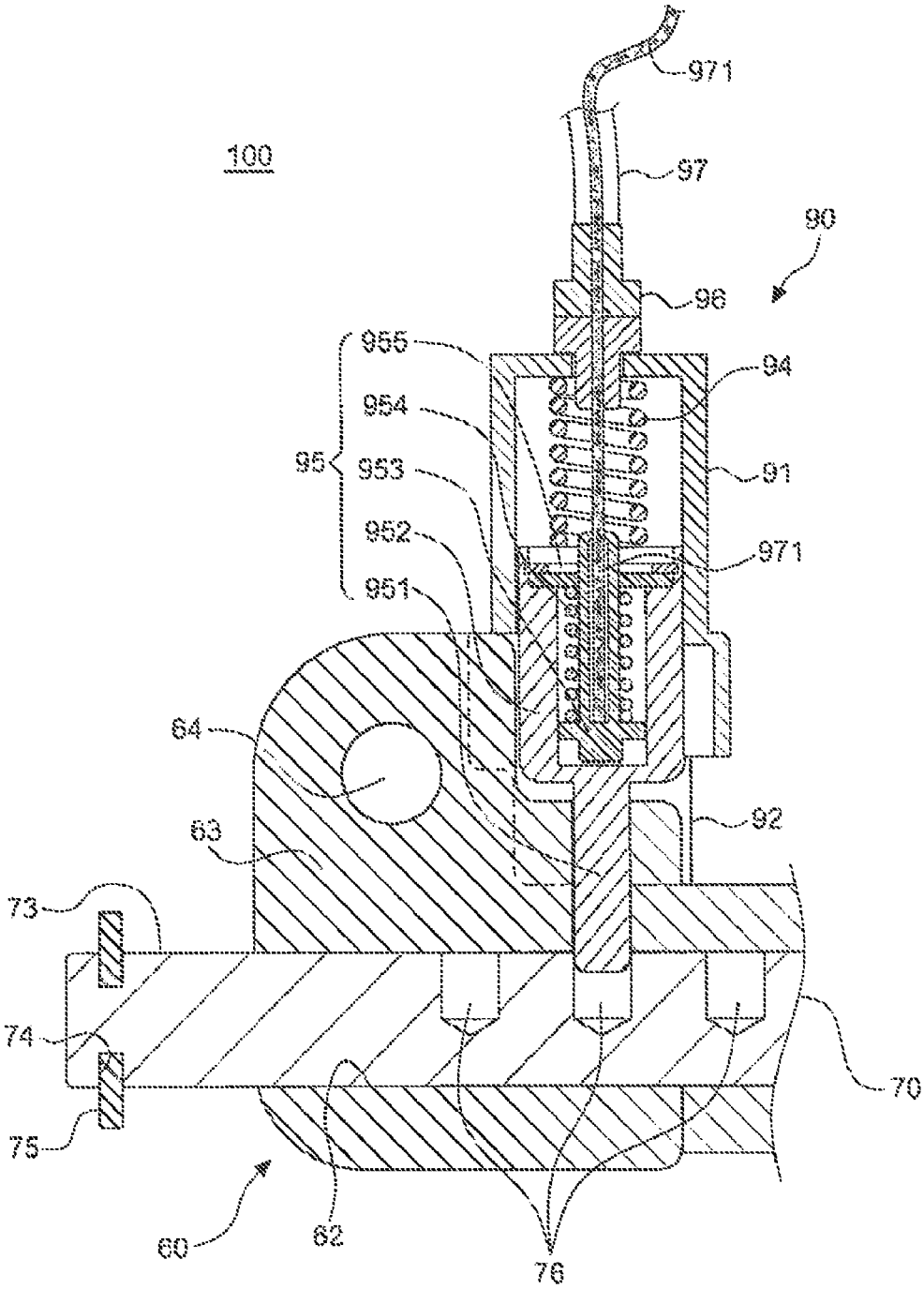
FIG. 8 is an enlarged view of the partial structure in FIG. 7.
Figure 11:
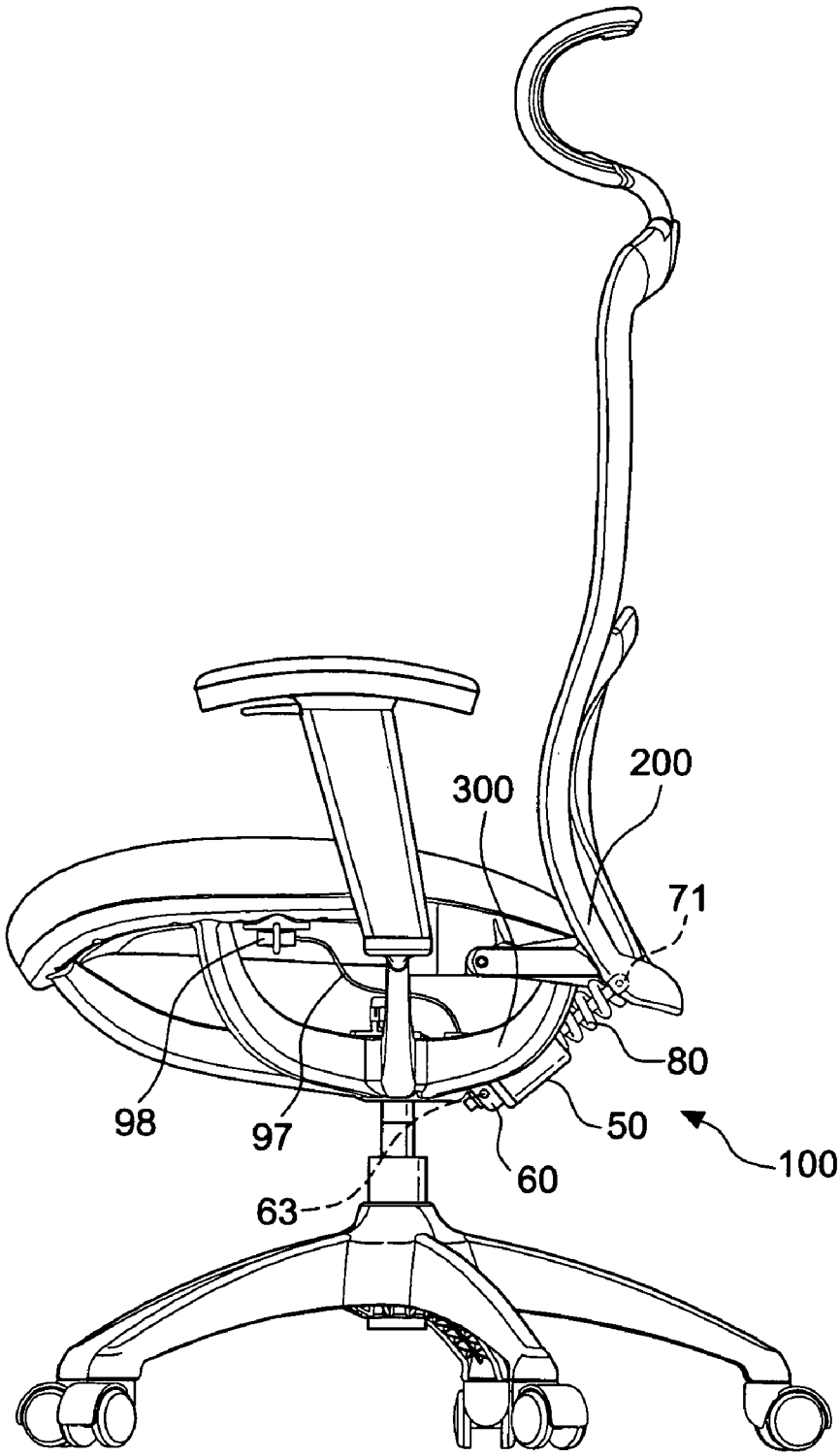
FIG. 11 is an application view of the apparatus for adjusting the seat back angle in accordance with the invention.

1. As shown in FIG. 7, the apparatus 100 in accordance with the invention is brought in a locked position. In other words, the insertion pin 951 of the locking device 90 is vertically inserted into one of the pin holes 76 of the shift shaft 70 such that a fixed length between the second pivoted portion 71 of the shift shaft 70 and the first pivoted portion 63 of the L-shaped connection body 60 is created. Referring now to FIG. 11, the seat back 200 is inclined at a certain angle when the pivoted portions 63, 71 are pivotally mounted on the seat portion 300 and the seat back 200, respectively.

Figure 9:
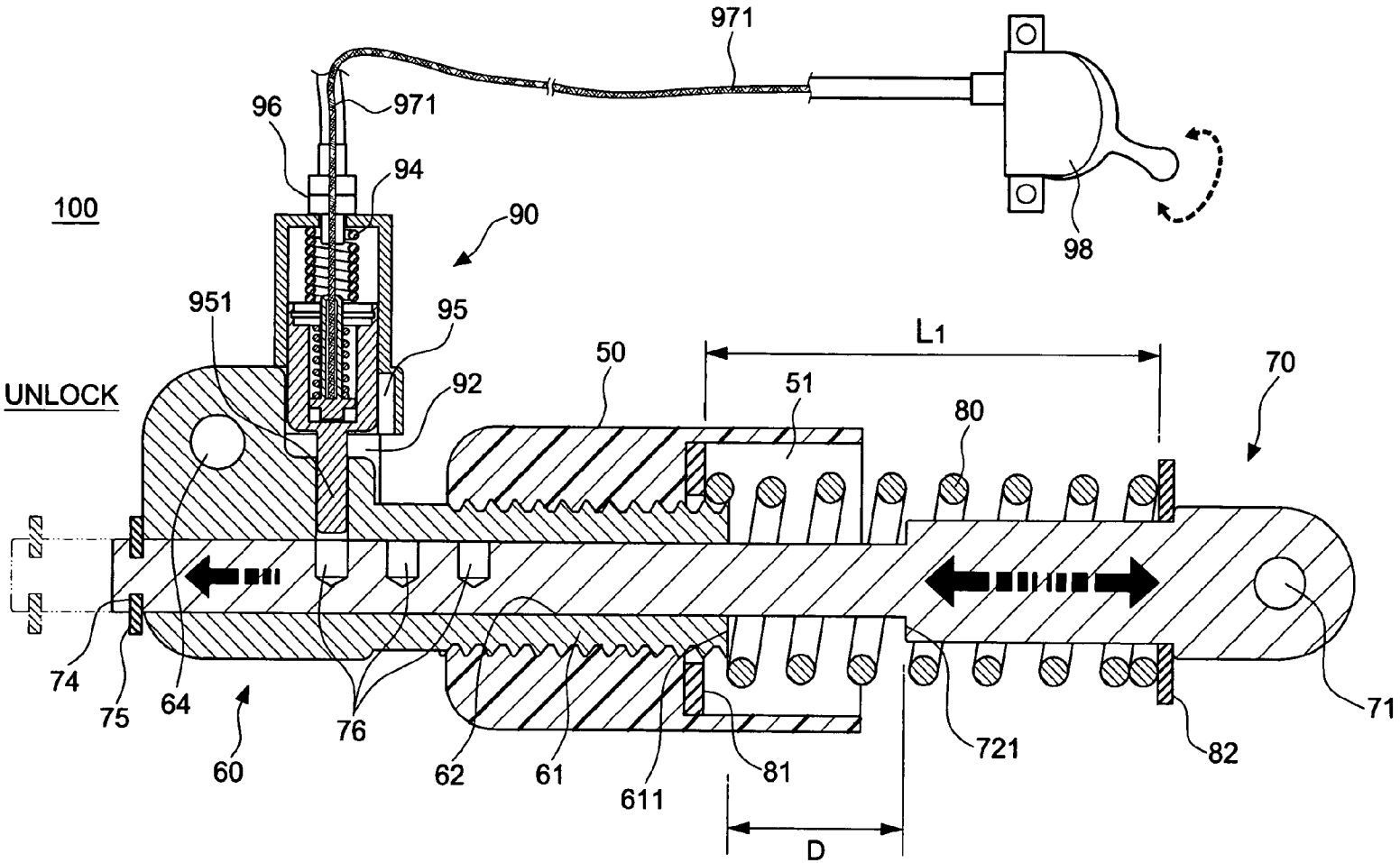
FIG. 9 is a cutaway view of an apparatus for adjusting the seat back angle in accordance with the invention in an unlocked position wherein the large spring has a greater telescopic length L1.
Figure 10:
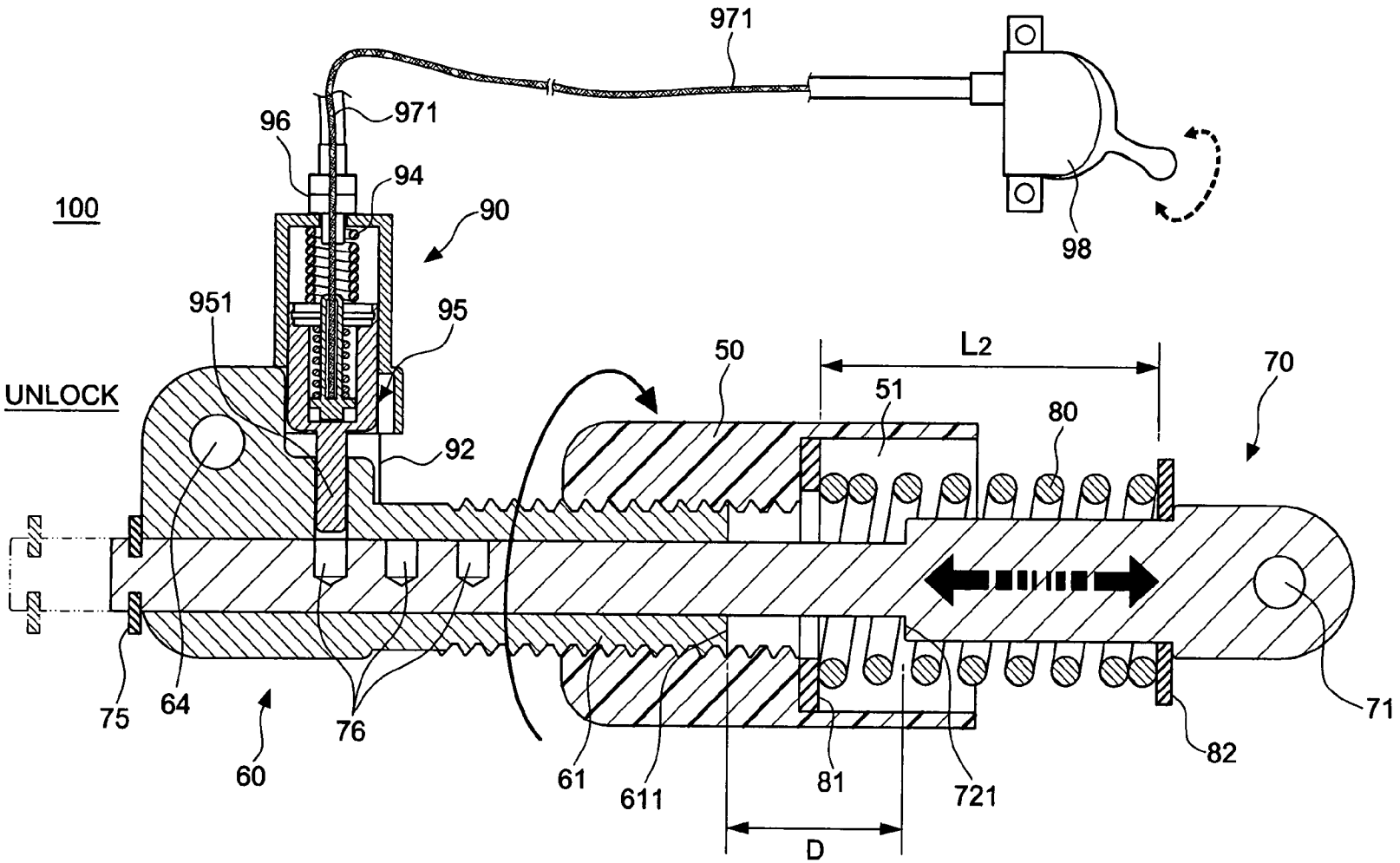
FIG. 10 is a cutaway view of an apparatus for adjusting the seat back angle in accordance with the invention in an unlocked position wherein the large spring has a shorter telescopic length L2.

2. As shown in FIG. 9, the apparatus 100 in accordance with the invention is brought in an unlocked position. In other words, the guide wire 971 is pulled by the control lever 98 of the locking device 90 such that the telescopic locking element 95 is moved upwards. In this way, the insertion pin 951 is removed from the pin hole 76 such that a variable length between the second pivoted portion 71 of the shift shaft 70 and the first pivoted portion 63 of the L-shaped connection body 60 is created. Referring now to FIG. 11, the first pivoted portion 63 pivoted at the rear side of the seat portion 300 is made unmovable while the shift shaft 70 is axially movable within the through hole 62 of the L-shaped connection body 60 such that the seat back 200 articulated on the second pivoted portion 71 may change its inclination angle with the to-and-fro swing of the operator's body at any time, thereby creating a cushioning resilience. The degree of the cushioning resilience is adjustable by the rotating sleeve 50. As shown in FIG. 9, the rotating sleeve 50 is disposed at the leftmost side of the threaded rod 61. At that time, the large spring 80 have a greatest telescopic length L1 and the shift shaft 70 has a looser resilience that is suitable for the operators with less weight. The shiftable distance of the shift shaft 70 is the distance D between the end stop 721 of the first stem 72 and an external face 611 of the threaded rod 61. The end stop may prevent the seat back from a too large inclination.

3. As shown in FIG. 7, the rotating sleeve 50 may be rotated in such a way that the rotating sleeve 50 is moved outward toward the external side of the threaded rod 61 when the operator has a greater weight. In this way, the large spring 80 is compressed to have a shorter telescopic length L2. At that time, the shift shaft 70 has a tighter resilience that is suitable for the operators with greater weight. As a result, the operators may adjust the resilience of the seat back 200 according to their own needs for obtaining a greatest sitting comfort.

Therefore, the apparatus for adjusting the seat back angle in accordance with the invention combines the structure having the adjustable positioning effect and the structure having the not-adjustable positioning effect into one body, thereby ensuring a convenient use. Thus, the apparatus for adjusting the seat back angle in accordance with the invention is a practical adjuster.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An apparatus for adjusting a seat back angle of a seat back, and more particularly an adjuster inclinedly disposed at a lower position of a bottom of the seat back and a rear side of a seat portion, comprising:

a) a rotating sleeve having an opening at a rotating sleeve front end thereof such that a cavity is created, a primary threaded hole being positioned in an axial direction relative to the rotating sleeve at a coaxial center of a bottom of the cavity;

b) an L-shaped connection body having a threaded rod at a lateral side thereof, the threaded rod being screwed into the primary threaded hole of the rotating sleeve, the threaded rod of the connection body having a primary through hole extended in the axial direction relative to the rotating sleeve, the L-shaped connection body having a first pivoted portion at a longitudinal side thereof, a radial hole being formed in the connection portion between the longitudinal side of the connection body and the threaded rod, the radial hole being formed to extend to the primary through hole;

c) a large spring having a tail portion fitting into the cavity of the rotating sleeve;

d) a shift shaft having a second pivoted portion at a shift shaft front end thereof, the second pivoted portion having a first external diameter and a pivotal hole through the second pivoted portion, a first stem having a smaller second external diameter than the first external diameter of the second pivoted portion and the first stem being positioned at an internal side of the second pivoted portion, a second stem having a smaller third diameter than the second diameter of the first stem and being disposed at an internal side of the first stem and fitting into the primary through hole of the threaded rod, an end stop having an external diameter greater than the primary through hole being formed at a connection area between the first stem and the second stem, a tail of the shift shaft passing through the large spring and the primary through hole first whereupon a positioning element at the end of the shift shaft is employed to fix the shift shaft within the connection body in such a manner that the shift shaft is axially movable and the large spring is confined between the second pivoted portion and the cavity, the second stem being provided with a plurality of pin holes corresponding to the radial hole of the connection body; and e) a locking device mounted on the radial hole of the L-shaped connection body, an insertion pin at an end of the locking device fitting in the radial hole and being extended into at least one of the prearranged pin holes of the second stem such that the shift shaft is locked in an unmovable state, the locking device further having a control lever; wherein, when the insertion pin is removed with the control lever, the shift shaft is unlocked in an axially movable state relative to the locking device, and wherein the compression state of the large spring is adjustable by a clockwise and counterclockwise rotation of the rotating sleeve on the threaded rod, thereby achieving a practical control of a telescopic tightness of the shift shaft.

2. The apparatus for adjusting the seat back angle as recited in claim 1 wherein a first pad is interposed between the large spring and the bottom of the cavity of the rotating sleeve, and wherein a second pad is interposed between the large spring and the internal side of the second pivoted portion of the shift shaft.

3. The apparatus for adjusting the seat back angle as recited in claim 1 wherein the positioning element at the tail of the shift shaft is a radially installed retaining clip engaged in a groove at the tail of the shift shaft.

4. The apparatus for adjusting the seat back angle as recited in claim 1 wherein the locking device includes:

a) a housing being hollow and having a connection hole at an end portion thereof, two positioning pieces being extended from the bottom of the right and left sides of the housing, the positioning pieces being provided with secondary through holes in the lateral and radial direction with respect to the rotating body, the locking device being mounted by the positioning pieces in alignment to the radial hole on the connection body and fixed by screws screwed through the secondary through holes into secondary threaded holes of the L-shaped connection body;

b) a middle spring positioned within the housing;

c) a telescopic locking element having the insertion pin at the bottom thereof, a hollow plug secured to the insertion pin, a stem disposed within the hollow plug, a small spring mounted on the stem, and two locking elements fixing the small spring within the hollow plug; and d) a connection element secured in the connection hole of the housing, the connection element being connected with a cable line, in which a pullable guide wire is positioned, a front end of the guide wire passing through the housing and being secured to the stem, a free end of the guide wire being attached to the control lever disposed on a chair, the guide wire being controlled by the control lever to impart an axial motion to the telescopic locking element.

* * * * *